US006152617A

United States Patent [19]

Earle et al.

[11] Patent Number: 6,152,617

[45] Date of Patent: Nov. 28, 2000

[54] PROCESSING PHOTOGRAPHIC MATERIAL

[75] Inventors: Anthony Earle, Harrow Weald; Jeffrey K. Green, Wealdstone; Zoë Orr, Watford; Leslie R. Wells, Brentford, all of United Kingdom

[73] Assignee: Eastman Kodak Company, Rochester, N.Y.

[21] Appl. No.: 09/167,936

[22] Filed: Oct. 6, 1998

[30] Foreign Application Priority Data

Oct. 9, 1997 [GB] United Kingdom ..... 9721460

[51] Int. Cl.[7] ..... G03D 5/00; G03D 5/06

[52] U.S. Cl. ..... 396/604; 396/606

[58] Field of Search ..... 396/604, 606, 396/618, 619, 627

[56] References Cited

U.S. PATENT DOCUMENTS 4,497,081 2/1985 Hecke et al. ..... 396/604
5,357,305 10/1994 Long ..... 396/604
5,734,945 3/1998 Earle et al. ..... 396/604
5,752,121 5/1998 Earle et al. ..... 396/606
5,758,223 5/1998 Kobayashi et al. ..... 396/604

FOREIGN PATENT DOCUMENTS

WO 89/11924 12/1989 WIPO .

*Primary Examiner*—D. Rutledge
*Attorney, Agent, or Firm*—Frank Pincelli

[57] ABSTRACT

Photographic material is processed in a sequence of stages by the application of solution to an upper surface thereof as the material is carried on endless belts beneath respective coated roller arrangements. Each roller arrangement is movably mounted in a slot so that the point along the stage at which the solution is applied to the photographic material can be varied, thereby to vary the time for which the material is subject to the processing treatment.

12 Claims, 1 Drawing Sheet

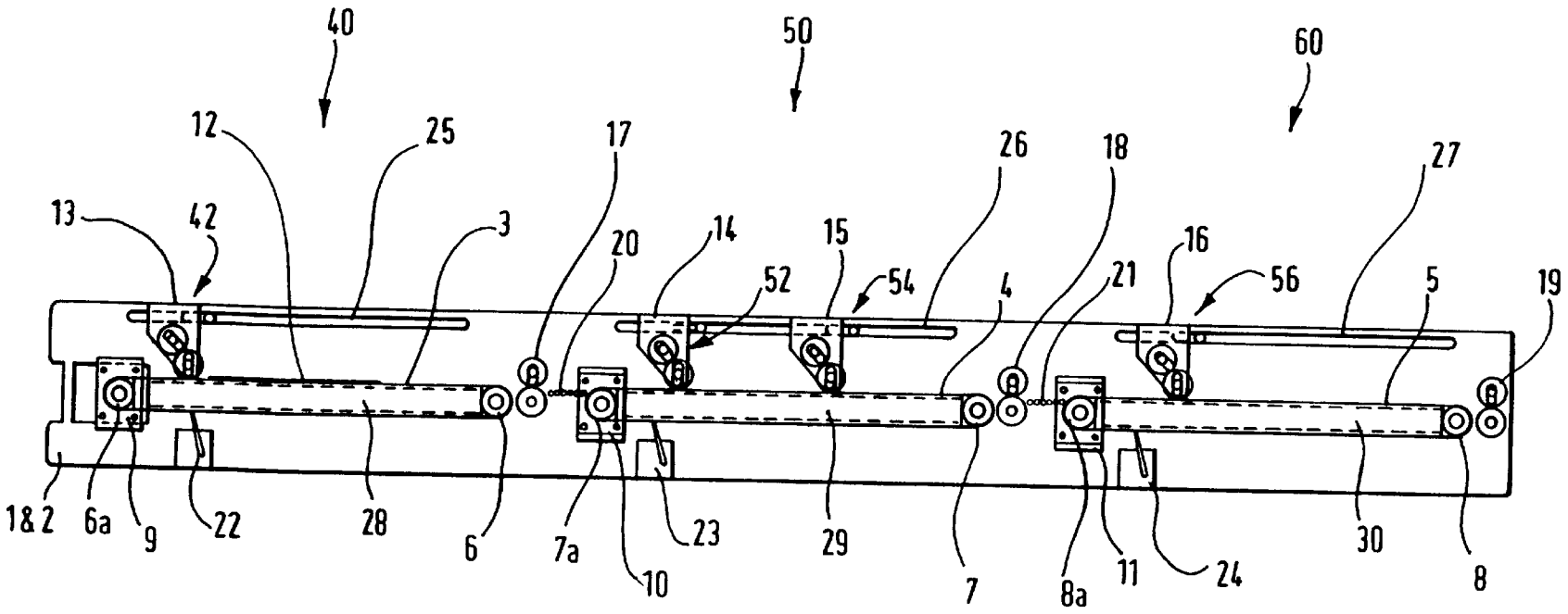
19
8
27
5
30
60
56
24
16
11
18
21
8a
26
4
7
54
15
29
50
52
14
23
10
17
20
7a
3
6
25
28
40
12
42
22
9
13
6a
1&2

PROCESSING PHOTOGRAPHIC MATERIAL

FIELD OF THE INVENTION

This invention relates to the processing of photographic material, which may already be exposed, and in particular to the application of processing solution to a surface of the material.

BACKGROUND OF THE INVENTION

Photographic material as referred to herein is understood to be generally planar, may comprise film or paper, may produce a black-and-white or color image, and may be in a continuous web form or may comprise discrete sheets.

Silver halide photographic materials are well-known, and are processed to generate a silver or dye image via a development stage followed by a series of stages to stabilize and provide permanence to the image. The wash stages convert and remove unwanted materials from the coated photographic layers which would either interfere with the quality of the final image or cause degradation of the image with time. In typical color systems the development stage is followed by a bleach stage to oxidize the developed silver to a form which can be dissolved by a fixing agent in the same or a separate bath. Such silver removal stages are then followed by a washing stage using water, or other wash solution, or a stabilization stage using a stabilizer solution. Such stages remove residual chemicals and may also include conversion reactions between stabilizer solution components and materials within the coated layers. These stages are required to provide the required degree of permanence to the final image.

The various processing stages may comprise baths in which batches of the photographic material are immersed, but these can involve large quantities of solution that have to be replenished to maintain their efficiency, and the effluent subsequently has to be removed. It also known to carry out surface processing of photographic material in which a metered amount of processing solution is deposited onto a surface of the material, resulting in only a small amount being carried over by the material from one stage to the next, thus significantly reducing the amount of effluent. U.S. Pat. No. 5,752,121 discloses surface processing apparatus in which solution is applied in precise quantities to the sensitized side of photographic sheet film as it is conveyed on an endless belt beneath an applicator arrangement that comprises three rollers. The processing solution, for example developer, is metered onto an upper roller and is then transferred to the film as it is driven thereunder by the belt. The film is then passed through further processing stages.

In known surface processors, the photographic material to be processed is driven through at a constant speed, and this is so even though different drive rollers may be driven separately, since the material has to pass continuously from one stage, for example drive belt, to another. However, it may not be necessary for the material to spend the same time in each of the stages. Also, different materials may need to reside in a given stage for different times to effect the required processing.

It is one object of the present invention to provide a processing apparatus and method that is more versatile than that presently available in its ability conveniently to accommodate differing processing requirements.

SUMMARY OF THE INVENTION

In accordance with one aspect of the present invention, there is provided apparatus for processing photographic material, including at least one processing stage that comprises:

means arranged to transport the material from an entrance to an exit of the stage;

an elongate substantially planar surface for supporting the transported material; and means for applying processing solution to the material disposed on the surface; wherein the application means is movably mounted, thereby to vary the location along the stage at which the solution is initially applied to the material.

The application means, which preferably comprises a roller arrangement for contacting the photographic material, may be slideably mounted in a slot for movement along the stage above the support surface for the material.

The apparatus may comprise further application means movably mounted within the stage and arranged to provide a further location at which processing solution may be applied to the material. The processing material applied by the further means may be the same as, or different from, that applied by the first-mentioned application means.

The apparatus may comprise at least two of the said processing stages, which may be disposed such that the material passes successively from one to the other.

It is also envisaged that the surface processing apparatus of the invention may form part of a photographic processor that comprises at least one other stage in which the material is immersed in a processing solution, either before or after the surface processing stage. For example, the surface processing stage may effect developing of the material, and the immersion stage may comprise one or more stages of bleaching, fixing and washing. Such further processing may be carried out in conventional so-called "deep" tanks that contain 1000 to 2000 liters of processing solution, or in the more modern LVTT (low volume thin tank) equipment using much less solution in narrow processing channels.

In accordance with another aspect of the present invention, there is provided a method of processing photographic material, wherein the material is transported on a substantially planar support surface from an entrance to an exit of the stage, wherein processing solution is applied to the material from an arrangement that is movably mounted along the stage, whereby the time that the material is subject to the processing solution can be varied.

The present invention thus allows the processing time to be varied from one photographic material and/or from one processing stage, to another in a particularly convenient manner. The material can be processed in the minimum time necessary without affecting the processing in other stages. For example, when discrete sheets are being processed, the processing conditions can be optimized, and varied, for each sheet, whilst the speed of all the sheets through the apparatus is maintained constant, and this can be achieved without the need for any buffer storage. It will be appreciated that this feature is also of advantage when processing continuous material.

Since the amount of processing solution used is comparatively small, of the order of 10 ml, its temperature can be varied quickly, again facilitating optimization of the processing conditions specific to the material in the stage at any one time.

Furthermore, no major washing out or apparatus configuration changes are necessary when changing the format of the photographic materials to be processed, for example from a graphic arts to a color process.

The ability to have more than one application point in a single stage allows, for example, RX (redox amplification) chemistry processing to take place conveniently, with the developer and the peroxide being applied separately and successively, for example at an interval of 1 or 2 seconds, within the stage.

BRIEF DESCRIPTION OF THE DRAWINGS

The drawing shows a schematic side sectional view of the apparatus.

DETAILED DESCRIPTION OF THE INVENTION

The apparatus has a pair of side plates 1 and 2, only one of which is shown at 1, between which extend horizontally three transport belts 3, 4, and 5 of successive processing stages 40, 50 and 60. The belts 3, 4 and 5 are independently driven by respective rollers 6, 7 and 8 at one end thereof, fed from a common motor (not shown). The tensioning of the transport belts 3, 4 and 5 is achieved by adjusting blocks 9, 10 and 11, respectively, that carry associated rollers 6*a*, 7*a* and 8*a* at the other end of the travel of the belts 3, 4 and 5.

The first processing stage 40 has an application arrangement 13 therein, which comprises a pair of rollers 42 slideably mounted in a guide slot 25, being fixed in position as each sheet 12 passes through the stage. The next processing stage 50 has two similar application arrangements 14 and 15 with their associated roller pairs 52 and 54, and the final surface processing stage 60 has a further similar single application arrangement 16 with its roller pair 56. Processing solution applicable to the processing being carried out in the stage is metered onto the rollers 42, 52, 54 and 56, respectively, from a delivery system (not shown).

In operation, discrete photographic film sheets 12 are fed into the first processing stage 40 through an aperture A, and onto the first belt 6 with their sensitized sides upwards. In each of the stages 40, 50 and 60, as the belts 3, 4 and 5 move, the sheet 12 is carried beneath the application arrangements 13, 14, 15 and 16, and this action rotates the rollers 42, 52, 54 and 56 which then coat the sensitized film 12 with the respective processing solution. The film sheet 12 leaves the belts 3, 4 and 5 as they pass around their end drive rollers 6, 7 and 8, with surplus solution from each stage 40, 50 and 60 being removed by respective pinch rollers 17, 18 and 19. Small diameter guide rollers 20 and 21 support the film 12 onto the following belt.

Since the drive belts 3,4 and 5 are endless, they return to the start of their respective stages, with surplus and used processing solution being removed by respective cleaning blades 22, 23 and 24.

The guide slots 25, 26 and 27 in the side plates 1 and 2 allow the application arrangements 13, 14, 15 and 16 to be moved to any position along their respective transport belts so that the process treatment time, that is to say the time the film 12 is subject to the processing solution, can be optimized in each stage for different films. For example, one film may require 10 seconds in stage 40, 15 seconds in stage 50 and 20 seconds in stage 60, while another may require only 5 seconds in stage 40 and 10 seconds in stage 50. As shown in stage 50, it is also possible to mount two application arrangements in one stage, which may dispense the same or different processing solutions onto the film 12.

The apparatus also includes platens 28, 29 and 30 in the stages which can be temperature controlled to suit the processing carried out in each stage, and can be controlled independently of the temperature in other stages.

It is to be understood that various other changes and modifications may be made without departing from the scope of the present invention, the present invention being limited by the following claims.

| PARTS LIST | |
|---|---|
| 1 | side plate |
| 2 | side plate |
| 3 | transport belt |
| 4 | transport belt |
| 5 | transport belt |
| 6 | roller |
| 6a | associated roller |
| 7 | roller |
| 7b | associated roller |
| 8 | roller |
| 8a | associated roller |
| 9 | blocks |
| 10 | blocks |
| 11 | blocks |
| 12 | photographic film sheet |
| 13 | application arrangement |
| 14 | application arrangement |
| 15 | application arrangement |
| 16 | application arrangement |
| 17 | pinch roller |
| 18 | pinch roller |
| 19 | pinch roller |
| 20 | guide roller |
| 21 | guide roller |
| 22 | cleaning blade |
| 23 | cleaning blade |
| 24 | cleaning blade |
| 25 | guide slot |
| 26 | guide slot |
| 27 | guide slot |
| 28 | platen |
| 29 | platen |
| 30 | platen |
| 40 | processing stage |
| 42 | rollers |
| 50 | processing stage |
| 52 | roller pair |
| 54 | roller pair |
| 56 | roller pair |
| 60 | processing stage |

What is claimed is:

1. An apparatus for processing photographic material, including at least one processing stage that comprises:

means arranged to transport the material from an entrance to an exit of the stage;

an elongate substantially planar surface for supporting the transported material; and application means for applying processing material directly onto the material disposed on the surface; wherein the application means is movably mounted, thereby to vary the location along the stage at which the solution is initially applied to the material.

2. An apparatus according to claim 1, wherein the application means is mounted for sliding movement along a slot.

3. An apparatus according to claim 1, wherein the application means comprises a roller arrangement for applying the processing solution to one side, preferably the upper side, of the material.

4. An apparatus according to claim 1, comprising further application means movably mounted within the stage and arranged to provide a further location at which processing solution may be applied to the material.

5. An apparatus according to claim 4, wherein each application means has a supply means connected respectively thereto, each supply means being arranged to apply a different processing solution to the material.

6. An apparatus according to claim 1, comprising at least two of said processing stages through which the material is arranged to pass.

7. An apparatus according to claim 1, comprising at least one other stage for processing the material in which the material is immersed in processing solution.

8. A method of processing photographic material, wherein the material is transported on a substantially planar support surface from an entrance to an exit of the stage, wherein processing solution is applied directly onto the material from an arrangement that is movably mounted along the stage, whereby the time that the material is subject to processing solution can be varied.

9. A method according to claim 8, wherein processing solution is applied to the material at least one further location that can be varied along the stage.

10. A method according to claim 9, wherein the processing solutions applied at the different locations are different from one another.

11. A method according to claim 8, wherein the processing solution is applied to one side of the material by being transferred thereto from a roller arrangement.

12. A method according to claim 8, wherein the material is passed through at least one further processing stage, in which it is immersed in processing solution.

* * * * *